United States Patent [19]

Stousland

[11] Patent Number: 4,482,594

[45] Date of Patent: Nov. 13, 1984

[54] FINE GAUGE CUT PILE TUFTED VELVET

[75] Inventor: Olay Stousland, Burlington, N.C.

[73] Assignee: Burlington Industries, Inc., Greensboro, N.C.

[21] Appl. No.: 267,618

[22] Filed: May 27, 1981

[51] Int. Cl.[3] ..... B32B 3/02

[52] U.S. Cl. ..... 428/92; 156/72; 156/250; 156/435; 428/93; 428/96; 428/97

[58] Field of Search ..... 428/85, 92, 93, 96, 428/97; 156/72, 250, 435

[56] References Cited

U.S. PATENT DOCUMENTS 2,753,614 7/1956 Repp ..... 28/73
2,902,397 9/1959 St. John ..... 156/72
2,908,013 10/1959 Keen et al. ..... 2/278
3,013,511 12/1961 Nebich ..... 112/79

*Primary Examiner*—Marion E. McCamish
*Attorney, Agent, or Firm*—Cushman, Darby & Cushman

[57] ABSTRACT

Staple fiber, typically of up to about 2.5 inches long, is preferably crimped and heat-set, then is open-end spun to product single yarns having about half the fibers in a non-parallel configuration. These are supplied to a fine gauge tufting machine which simultaneously tufts the yarns into a scrim substrate and shears the tufted loops e.g. to a one-eighth inch pile height. A conventional backing is applied. The resulting product more closely resembles woven velvet than does conventionally tufted velvet and is especially suitable for use as upholstery fabric.

15 Claims, 1 Drawing Figure

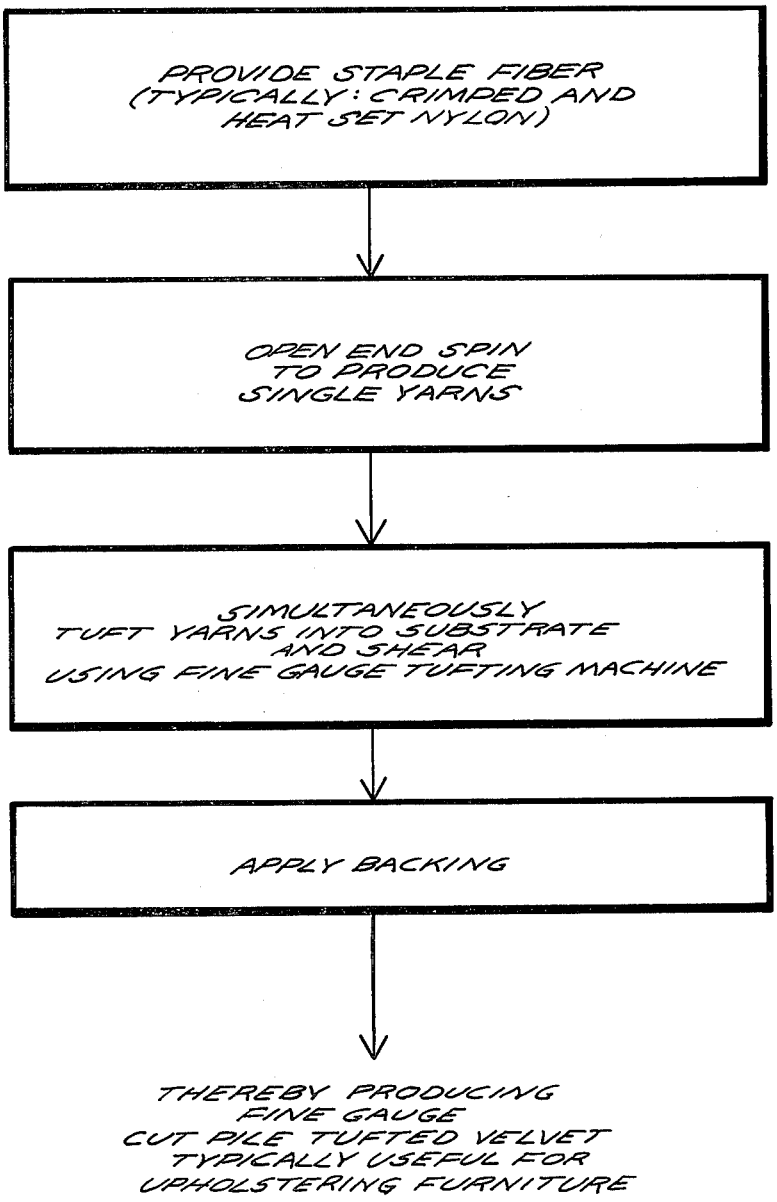
PROVIDE STAPLE FIBER (TYPICALLY: CRIMPED AND HEAT SET NYLON)
OPEN END SPIN TO PRODUCE SINGLE YARNS
SIMULTANEOUSLY TUFT YARNS INTO SUBSTRATE AND SHEAR USING FINE GAUGE TUFTING MACHINE
APPLY BACKING
THEREBY PRODUCING FINE GAUGE CUT PILE TUFTED VELVET TYPICALLY USEFUL FOR UPHOLSTERING FURNITURE

FINE GAUGE CUT PILE TUFTED VELVET

BACKGROUND OF THE INVENTION

Historically, the term "velvet" has long referred to a plush woven fabric of distinctive appearance and hand. However, the comparative low productivity inherent in the weaving of such a fabric has caused the traditional velvet product to be largely displaced from the marketplace for many end uses, e.g. for upholstering furniture, by a tufted product that is similar in appearance and hand. The tufted product has come to be called "velvet" as well.

Prior to this time it has been known to fabricate a woven type "velvet" upholstery fabric on a fine-gauge, loop tufting machine. After tufting, the material was subsequently sheared to give the desired appearance and hand. This prior art tufted velvet fabric has typically been manufactured from ring spun yarn and tended to have occasional unsheared loops. Furthermore, the tufted velvet gave the surface appearance of having distinct "rows" of loops or tufts and thereby diminished the luxurious, plush appearance available in more expensive woven velvet fabrics.

SUMMARY OF THE INVENTION

Staple fiber, typically of nylon up to about 2.5 inches long, is preferably crimped and heat-set, then is open-end spun to produce single yarns having about half the fibers in a non-parallel configuration. These are supplied to a fine guage tufting machine which simultaneously tufts the yarns into a scrim substrate and shears the tufted loops, e.g. to a one-eighth inch pile height. A conventional backing is applied. The resulting product more closely resembles woven velvet than does conventionally tufted velvet and is especially suitable for use as upholstery fabric.

The principles of the invention will be further discussed with reference to the drawing wherein a preferred embodiment is shown. The specifics illustrated in the drawing are intended to exemplify, rather tha limit, aspects of the invention as defined in the claims.

BRIEF DESCRIPTION OF THE DRAWING

In the Drawing

The FIGURE is a diagram of steps in the manufacture of the improved tufted velvet product of the invention.

DETAILED DESCRIPTION

Staple fiber preferably is conventionally crimped and conventionally heat set as shown in the FIGURE.

Typically useful fiber is a 10/1 50/50 blend of DuPont Type 200 dull nylon fiber and DuPont Type 155 trilobal bright nylon fiber.

Further examples of typically useful fiber are:

(a) 10/1 100% nylon, heat set fiber, with bright round cross-section fiber;

(b) 12/1 100% nylon, heat set fiber, with bright round cross-section fiber;

(c) 10/1 50/50 nylon bright, round cross-section fiber/bright rayon fiber;

(d) 12/1 50/50 nylon bright, round cross-section fiber/bright rayon fiber;

(e) 10/1 100% bright polyester, regular dye. Yarn heat set; yarn not heat set;

(f) 10/1 100% polyester, easy dyeable;

(g) 500/96 den T-744 cationic dyeable filament nylon used for cross dyeing purpose to create stria effects.

Preferably, the staple is no longer than two and one-half inches in length.

The staple fiber is open end spun on an open end spinning machine to produce the requisite number of yarns. Preferably these are single yarns, which are cheaper to make than the equivalent counts of ply yarns. Further, these open end spun yarns have about half of their fibers in a non-parallel configuration.

The open end spun yarns are fed to a fine gauge tufting machine of the conventional type in which each loop is cut or sheared immediately following its insertion, e.g. while still caught by a loop-former. The tufting machine is also supplied with a substrate into which the tufts are to be inserted.

A typically useful substrate is high wet modulus rayon scrim comprised of a 25.5/1 warp of 68 sley and 10/1 filling of 32 picks/inch, the scrim having been sized with PVA and framed for stabilization.

The tufting machine typically is a 20 gauge machine inserting 17 stitches per inch, shearing as it goes.

The resulting tufted velvet typically weighs approximately eight ounces per square yard. The rows of sheared tufts are substantially less visually distinct on the face, and the shearing is more uniform than that obtained through the post-tufting shearing of prior art tufted velvet made using ring spun yarns.

A conventional backing, e.g. of SBR latex may be conventionally applied and set or cured.

The resulting velvet cloth is typically useful in practicing the art of upholstering furniture, e.g. to cover sofas and chairs.

Open end spun yarns are more even, less fuzzy and cheaper to spin because of speeds than ring spun yarns. Single yarns are cheaper than the equivalent counts of ply yarns. The high rate of productivity of tufting machines as compared to plush weaving is notable: to produce, by weaving, a velvet having the same amount of pile per lineal yard as can be produced by one fine gauge tufting machine would require about 5 or 6 weaving machines. These factors contribute to the savings that may be achieved through use of the present invention.

It should now be apparent that the improved fine gauge cut pile tufted velvet as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A process for producing an improved fine gauge cut pile tufted velvet, comprising:

crimping and heat setting staple fiber;

open end spinning the crimped and heat set staple fiber to produce yarn;

fine gauge tufting the yarn into a substrate and simultaneously cutting the tufts to produce a sheared pile; and applying a backing to secure the pile to the substrate.

2. The process of claim 1, wherein:

the staple fiber is selected to have lengths up to 2.5 inches long.

3. The process of claim 1, wherein:

in the spinning step, the staple fiber is open end spun to produce a plurality of single yarns; and in the tufting step, the plurality of single yarns is stitched into the substrate in a corresponding plurality of rows.

4. The process of claim 1, wherein:

in the cutting step, the sheared pile thereby produced is about one-eighth inch in height.

5. The process of claim 1, wherein:

in the tufting step, the yarn is 20 gauge tufted into the substrate.

6. The process of claim 1, wherein:

the staple fiber is selected from the group consisting of nylon, rayon, polyester and nylon/rayon blend.

7. Tufted velvet cloth produced by the process of claim 1.

8. Furniture upholstery fabric produced by the process of claim 1.

9. An improved fine gauge cut pile tufted velvet cloth, comprising:

a substrate;

a plurality of rows of sheared fine gauge tufts of crimped and heat open spun staple fiber yarn tufted to the substrate; and a backing anchoring the tufts to the substrate.

10. The tufted velvet cloth of claim 9, wherein:

the staple fiber is selected from the group consisting of nylon, rayon, polyester and nylon/rayon blend.

11. The tufted velvet cloth of claim 9, wherein:

the yarn is single yarn.

12. The tufted velvet cloth of claim 9, wherein:

the tufts are 20 gauge tufts.

13. The tufted velvet cloth of claim 9, wherein:

the tufts extend about one-eighth inch above the substrate as a pile.

14. The tufted velvet cloth of claim 9, wherein:

the substrate is woven rayon scrim.

15. The tufted velvet cloth of claim 9, wherein:

about half the staple fibers in the yarn are in a non-parallel configuration.

* * * * *